United States Patent [19]

Mahieu

[11] Patent Number: 4,904,977

[45] Date of Patent: Feb. 27, 1990

[54] SUPERSONIC EXPULSION FUSE

[76] Inventor: William R. Mahieu, R.R. 4, Centralia, Mo. 65240

[21] Appl. No.: 310,794

[22] Filed: Feb. 14, 1989

Related U.S. Application Data

[63] Continuation-in-part of Ser. No. 205,660, Jun. 13, 1988.

[51] Int. Cl.[4] ..... H01H 85/42

[52] U.S. Cl. ..... 337/281; 337/203; 337/249

[58] Field of Search ..... 337/203, 217, 249, 281, 337/282

[56] References Cited

U.S. PATENT DOCUMENTS

| | | | |
|---|---|---|---|
| 2,694,123 | 11/1954 | Smith, Jr. | 337/281 |
| 3,760,209 | 9/1973 | Hult | 310/91 |
| 4,705,972 | 11/1987 | Baines | 330/71 |
| 4,727,274 | 2/1988 | Adam et al. | 310/239 |

FOREIGN PATENT DOCUMENTS

| | | | |
|---|---|---|---|
| 681390 | 9/1939 | Fed. Rep. of Germany | 337/249 |
| 134753 | 9/1980 | Japan . | |
| 93465 | 6/1985 | Japan . | |

*Primary Examiner*—H. Broome

*Attorney, Agent, or Firm*—Fitch, Even, Tabin & Flannery

[57] ABSTRACT

This invention provides a supersonic expulsion fuse for interrupting fault currents in high voltage alternating current networks. It creates an arc interruption region with a long length of supersonic turbulent flow and little or no subsonic plasma. This increases the arc interrupting capability against both thermal and dielectric arc reignitions. Therefore, the transient recovery voltage the network applies across the interrupted arc after current-zero may be increased in both frequency and peak values, relative to present-art expulsion fuses. It may be applied on power distribution systems as a power fuse in enclosures or overhead where the said system transient recovery voltages exceed the capabilities of conventional distribution cutouts.

38 Claims, 3 Drawing Sheets

SUPERSONIC EXPULSION FUSE

RELATED APPLICATIONS

This is a continuation-in-part of U.S. patent application Ser. No. 07/205,660 filed June 13, 1988.

BACKGROUND OF THE INVENTION

Electrical power is generated, transmitted and distributed at various voltages, with transmission typically at hundreds of kV and distribution at 35 kV or less. System faults on alternating current networks are interrupted by equipment or devices which create an arc during the high current period of a half cycle and extinguish it at a natural current zero, which occurs twice each cycle. The difficulty and cost of interrupting a fault arc at current-zero increases with system voltage. Circuit breakers with separable contacts are typically used at transmission voltages and are highly complex and expensive equipment. At distribution voltages two fault interruption means are dominant. Reclosers (small circuit breakers) are used for transient faults and fuses, which must be manually replaced, are used for permanent faults requiring repair or replacement of other equipment. Expulsion fuses, which produce their own arc quenching gases, have historically been the dominant means for protection against permanent faults on overhead distribution systems.

Increasing demand for electrical power has resulted in distribution at higher voltages and has increased the required performance capabilities of distribution fuses in terms of voltage, load current, available fault current and transient recovery voltage frequency. Expulsion fuses are typically limited to 20 kA fault current interrupting ratings at a 5 kHz Transient Recovery Voltage frequency or lower. Current limiting fuses have been developed in the last decade or two for higher fault current duty (see U.S. Pat. No. 3,863,187 issued to William R. Mahieu, et al., which is herein incorporated by reference). However, load and voltage ratings are not always sufficient and their cost is high relative to distribution cutouts. There is an increasing need for distribution expulsion fuses with higher load and fault ratings at minimum costs.

Present-art expulsion fuses generate arc quench gases in a relatively long length (about 10 inches), large diameter bore (about 1 inch) arc tube and expel it to the ambient air where expansion as a free jet produces supersonic velocities over a short length. Thus, cooling of the decaying arc path between the two arc terminating electrodes in present-art expulsion fuses after current-zero is dependent upon two distinct processes: reduction in diameter of the subsonic plasma residual in said long and large arc bore and turbulent mixing of supersonic plasma flow external to the arc tube in the ambient air. These two processes are governed by different arc cooling time constants, with the subsonic cooling in the arc tube requiring more time and thereby limiting the fault interrupting performance against the rapidly rising system voltage across the two segments of the cooling arc path. If the system voltage increases too rapidly (transient recovery voltage frequency is too high) the arc will reheat and a thermal reignition of the arc will occur. Also, the peak value of the transient recovery voltage may exceed the dielectric strength of the deionized, but still hot decayed arc path and produce a dielectric reignition.

Companies which develop transmission circuit breakers have applied sophisticated experimental techniques and computer based numerical simulations to the current-zero arc interruption process in axial flow gas circuit breakers (see Klaus Ragaller, Editor, *Current Interruption in High-Voltage Networks,* Plenum Press, New York, 1978). Gas breakers have electrical contacts which separate along the axis of a single or dual Laval (converging, diverging) nozzle. They use stored high pressure gas for arc cooling at current-zero and complex timing and actuation means. That research has shown that nearly all of the network voltage develops across the supersonic, turbulent flow in the diverging nozzle section downstream from the throat or minimum flow area where sonic velocities are reached. Many of the breaker design parameters which significantly affect interruption performance have also been identified.

This invention was the result of an effort to apply recent knowledge of gas circuit breaker performance to a low cost, high performance expulsion fuse which generates its own arc quench gases for application on distribution power systems.

It is an object of the present invention to provide an improved expulsion fuse having increased supersonic flow characteristics.

SUMMARY OF THE INVENTION

These and other objects and advantages which will become apparent from studying the appended description and drawings are attained in an expulsion fuse for use in an ambient environment to interrupt current through an alternating current circuit, comprising:

a housing;

first and second spaced electrodes in said housing electrically connected to said network to conduct the circuit current therethrough;

a fusible element electrically coupling said electrodes and generating a pressurized gas when an overload current is passed therethrough;

nozzle means for directing said pressurized gas, surrounding at least a portion of said fusible element, said nozzle means having first and second opposed ends and a central passageway through which said fusible element passes, said passageway having a preselected length and cross-section, and said nozzle means defining a minimum flow area for directing pressurized gas therein;

a pressure chamber sealing the first end of said nozzle means, and enclosing said first electrode;

an expansion chamber adjacent the second end of said nozzle opening to said ambient environment.

In one embodiment, the expansion chamber has a greater cross-sectional area and longer length than the nozzle means.

In another embodiment, piston means are provided in said expansion chamber for sealing the second end of said nozzle.

In other embodiments, said second electrode is disposed in one of said expansion chamber and said ambient environment.

The present invention increases the fault interrupting capabilities of expulsion fuses in high voltage networks by providing fuse structure which creates a long length of supersonic turbulent flow and little or no subsonic plasma, at the first current zero following arc initiation in said fuses. Thus, expulsion fuse ratings may be increased in recovery voltage, transient recovery voltage frequency and fault current magnitude. The novel structure is also compatible with the need for distribution expulsion fuses having high ampacity (continuous load current) ratings with low initial and replacement costs.

Six primary discoveries were made in achieving the invented structure. First it was discovered that a short length (about 1 inch), small diameter (about 0.1 inch) nozzle which remains filled with arc plasma (clogged) during most of a high current arcing period is an ideal device for producing bidirectional clogged flow, one stream of which can be used to produce the arc quench gases and high pressures necessary for supersonic arc cooling after fault current-zero and the other stream can be used to lengthen the arc path in the supersonic flow region prior to the first current-zero following arc initiation in said nozzle. These dimensions (length and diameter) of the constricting nozzle are up to an order of magnitude lower than those of conventional expulsion fuses. Another important function of the clogging nozzle is that it switches automatically to the unidirectional flow that is needed for supersonic turbulent arc cooling during the fault arc interrupting period.

Second, a study of gas circuit breaker research revealed that the length of subsonic plasma at current zero controlled the cooling time constant of the subsonic plasma upstream from the sonic flow section of minimum flow area. In this application, the length of subsonic plasma flow at interrupting current-zero (current-zero immediately prior to fault current interruption) is related to the transient recovery voltage frequency of the network and the average atomic weight of the arc plasma. Subsonic plasma lengths, for arcs with high atomic hydrogen content, of less than two inches can provide fault interrupting capabilities against network Transient Recovery Voltage frequencies greater than 5 kHz. More importantly, the subsonic plasma length can be reduced to nearly zero by locating the high pressure arc terminating electrode at the position of minimum flow area, where sonic velocities occur. In this manner, the current-zero subsonic plasma is practically eliminated and no longer the primary factor in limiting the fault interrupting performance of expulsion fuses.

To attain the advantages of minimum length of subsonic plasma at interrupting current-zero also requires the plasma stream used to produce arc quench gases during clogged bidirectional flow to be deionized and cooled prior to current-zero, converting it into a relatively cool gas which may be used for cooling the residual arc plasma following interrupting current-zero. It was discovered that the high ionization energies released as radiation during recombination of plasma ions can best be absorbed by the energy required to rupture covalent polymer bonds. The ablated low temperature gases can then be turbulently mixed with the high temperature plasma to cool it below its ionization threshold temperature. Thus, polymers with high atomic hydrogen content and a geometric shape which does not interfere with the turbulent mixing flow of the incoming plasma can be added to the pressure chamber to create a plasma-to-quench-gas converter capable of increasing the fault interrupting performance of a supersonic expulsion fuse.

Fourth, it was discovered that optimum fault interruption performance in a supersonic expulsion fuse could be achieved by limiting the supersonic expansion to flow pressure greater than ambient. This requires controlling the supersonic flow expansion in two stages: an initial divergent flow with increasing flow area towards the ambient to achieve the highest Mach number flow in the shortest time and distance; a parallel flow of constant flow area, beginning at a flow pressure greater than ambient, to retain the high Mach flow to the ambient, where it will encounter a shock wave, across which flow velocities become subsonic. The transition from divergent to parallel flow must occur at a flow pressure sufficiently above ambient pressure to move the transitional shock wave into the ambient dielectric gas. This two-staged, controlled expansion provides the longest length of supersonic, turbulent flow at the highest Mach numbers which the stored pressure, quench gas composition and arc eroded minimum flow area permit.

Fifth, it was discovered that the parallel flow section of the expansion chamber could be used in a piston-cylinder arrangement to accelerate nonfused conductive metals out of the supersonic fault arc interruption chamber prior to interrupting current-zero. This permits a short length fuse element for high ampacity ratings and a long supersonic turbulent mixing length for high fault interruption ratings.

Finally, it was discovered that the length of subsonic plasma from the location of stagnation pressure to the sonic flow area also determines the turbulent cooling time constant in the supersonic flow in the expansion chamber. Thus, the invented structure not only effectively eliminates the subsonic plasma as a limitation on fault interruption performance, it also maximizes the supersonic turbulent cooling rate and therefore maximizes fault interruption performance.

DETAILED DESCRIPTION OF THE PREFERRED EMBODIMENTS

Figure 1:
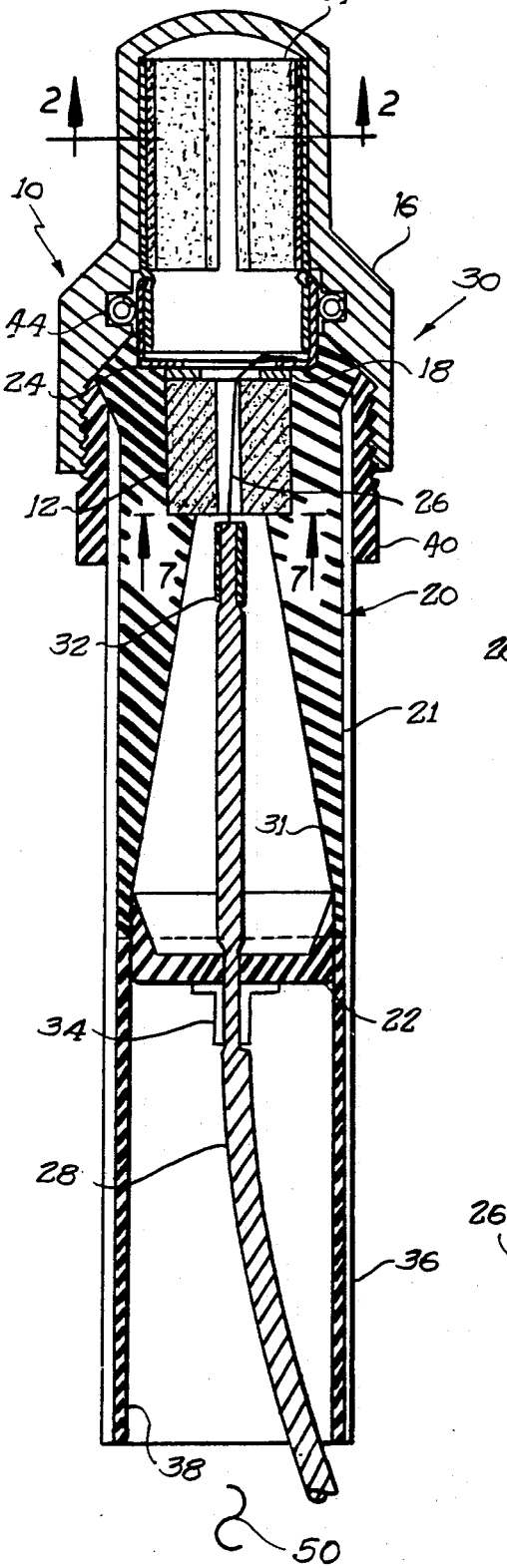
FIG. 1 is a cross-sectional view, with the section plane including the longitudinal axis, of a supersonic expulsion fuse of the present invention.
Figure 2:
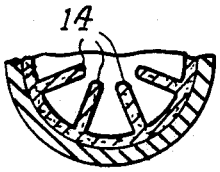
FIG. 2 is a cross-section view taken along sight line 2—2 of FIG. 1, showing the plasma conversion means.

A supersonic expulsion fuse in one of its preferred structures is generally denoted by numeral 10 in FIG. 1. The fuse axis is symmetrical for all components except fusible element 26 and its flexible conductor 28, both of which terminate off the fuse axis. Fuse 10 consists of a replaceable fuse cartridge 20 and a permanent fuse holder 30.

Figure 3:
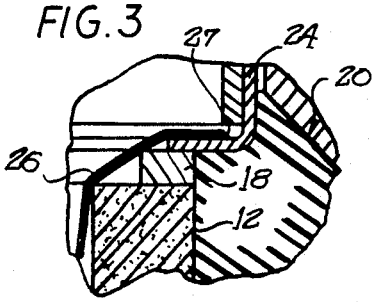
FIG. 3 is a fragmentary, enlarged, cross-sectional view showing a high pressure, arc terminating electrode of carbon.
Figure 4:
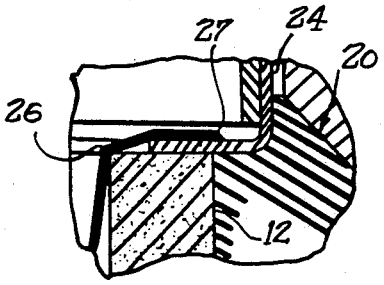
FIG. 4 is a fragmentary, enlarged, cross-sectional view showing a metallic high pressure, arc terminating electrode.

Replacement fuse cartridge 20 consists of a fuse body 21, which receives and retains the following components: an arc plasma clogging nozzle 12; a high pressure arc terminating electrode 18 (which, as will be seen, defines a minimum flow area for plasma during fault interruption); a contact ferrule 24, with attached plasma conversion means 14; a piston 22 which travels over part of the supersonic flow path; a flexible conductor 28 attached to piston 22 by compression connector 34 and to fusible element 26 by a compression connector 32; a fusible element 26 which passes through nozzle 12, a high pressure electrode 18, and a contact ferrule 24 to which it is soldered at 27, as shown in the enlarged views of FIG. 3 and FIG. 4.

Permanent fuse holder 30 separates at the threaded connection between converter cap 16 and bushing 40. When separated, replacement fuse cartridge 20 is inserted into fuse tube 36, with piston 22 sliding into fuse tube lining 38 against which it seals under expulsion pressure during fault interruption. Converter cap 16 contains spring contact 44, which forms multiple electrical contacts between converter cap 16 and contact ferrule 24 of the fuse cartridge.

With fuse cartridge 20 in place, converter cap 16 is positioned over plasma converter 14 and tightened with bushing 40. The conical upper surface of fuse body 21 seals against the inner surface of converter cap 16 to prevent high pressure gases from entering the cylindrical interface between fuse body 21 and fuse tube 36 or from being vented to the ambient through the threaded connection.

Supersonic expulsion fuse assembly 10 may be adapted for mounting in various devices and equipment such as overhead distribution cutouts or in pad-mounted gear and distribution substations. No specific mounting details are shown in FIG. 1 for that reason. Any conventional mounting means can be used to make electrical connection with the upper ferrule-like portion of converter cap 16 and with flexible conductor 28. The electrical conduction path through fuse 10 is from an external upper mounting contact (not shown) through converter cap 16, coiled spring contact 44, contact ferrule 24, solder connection 27, fusible element 26 and flexible conductor 28 to an external lower mounting contact (not shown).

The materials from which replacement fuse cartridge 20 is constructed are important for attaining high performance at low cost. All materials which are eroded significantly by arc heating are to have high atomic percentages of hydrogen, to attain the highest fault interruption performance. Such materials include silicone polymer with methyl radicals (60% hydrogen) and polyolefin polymers such as polypropylene (67% hydrogen). For example, fuse body 21 and piston 22 are preferably made from injection molded polypropylene. Plasma clogging nozzle 12 is preferably made from molded silicone polymer for its higher continuous use temperature. Plasma conversion means 14 may preferably be made of extruded polypropylene.

The arc terminating electrode located on the high pressure side of clogging nozzle 12 may be metallic, as shown at 24 in FIG. 4, or carbon in an amorphous and/or a graphite form, as shown at 18 in FIG. 3 and FIG. 1. The higher ionization energies of carbon make it the preferred material for higher fault interruption performance.

Fusible element 26 is made of high conductivity metals such as silver or copper when high ampacity is a requirement. With these high melting point metals, the eutectic alloy or solder connection 27 with contact ferrule 24 melts first on overload currents. Solder 27 will then have a melting point lower than that of fuse body 21 and clogging nozzle 12.

Materials in permanent fuse holder 30 are typical of the present fuse art. Converter cap 16, bushing 40 and contact ferrule 24 are of brass, machined (16 and 40) or die formed (24). Fuse tube 36 is a glass fiber reinforced epoxy, filament wound tube, with a bonded polymer lining 38. Fuse tube 36 is adhesively bonded to busing 40.

Assembly of replacement fuse cartridge 20 will be approximately in the following order: fuse element 26 is attached to flexible conductor 28 using compression connector 32; piston 22 is attached to conductor 28 using compression fitting 34; clogging nozzle 12, high pressure arc terminating electrode 18 and contact ferrule 24 are pressed into fuse body 21; fusible element 26 is inserted through fuse body 21, clogging nozzle 12, arc electrode 18, contact ferrule 24 and soldered to contact ferrule 24; plasma conversion means 14 is inserted into contact ferrule 24, which is then crimped around 14 to retain it and allow easy insertion into spring contact 44.

Figure 5:
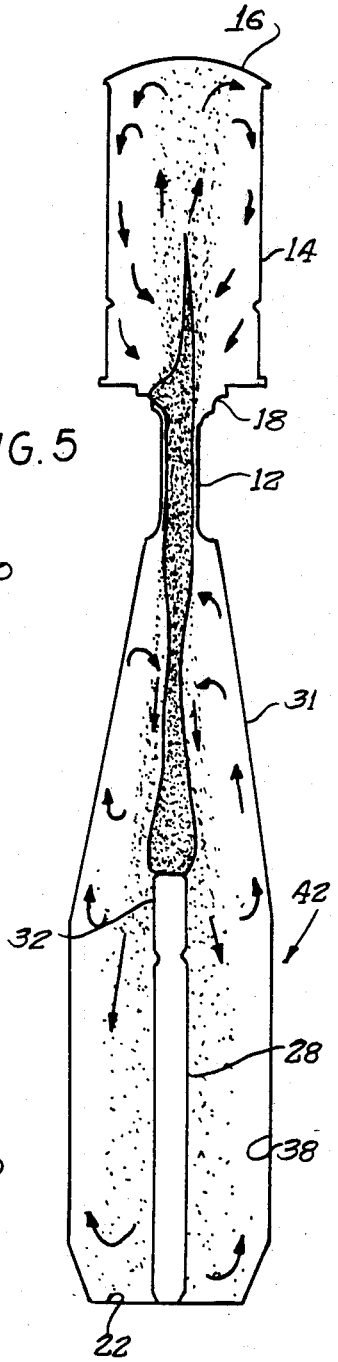
FIG. 5 is a cross-sectional view, with the section plane through the longitudinal axis, of the supersonic expulsion fuse in FIG. 1, showing only the bidirectional flow during high current arcing and those internal fuse surfaces which are exposed to arc plasma.
Figure 6:
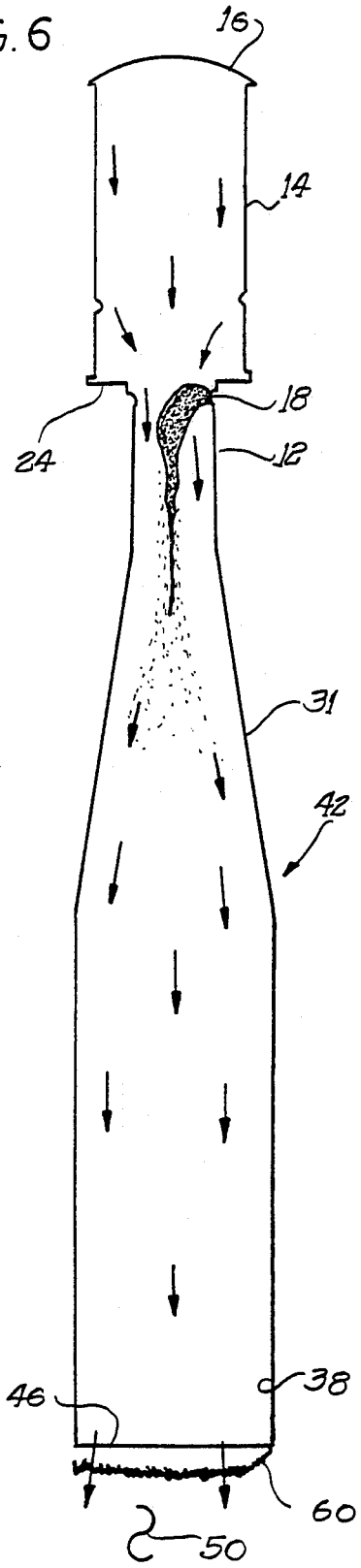
FIG. 6 is a cross-sectional view, with the section plane through the longitudinal axis, of the supersonic expulsion fuse in FIG. 1, showing only the unidirectional flow just after interrupting current-zero and those internal fuse surfaces which are exposed to arc plasma.

The unique function of supersonic expulsion fuse 10 is shown in FIG. 5 and FIG. 6, which are longitudinal cross sections of the high fault current arcing process and the inner surfaces of the fuse structure that are exposed to arc plasma during fault arc current interruption. FIG. 5 shows the fault interrupting arc during the high current period when nozzle 12 is plasma filled (clogged), ablating rapidly and producing bidirectional plasma flow into converter cap 16 and an expansion chamber 42. The structure defining expansion chamber 42 will be described below. For the same fault, FIG. 6 shows the unidirectional flow, during the fault arc interrupting period after current-zero and before transient recovery voltage peak, from converter cap 16 and enclosed plasma conversion means 14, through the arc terminating carbon ring electrode 18, through the supersonic turbulent mixing flow in expansion chamber 42 and across the shock wave 60 as the flow enters the ambient air 50. A detailed description of the arcing function shown in FIG. 5 and FIG. 6 of supersonic expulsion fuse 10 follows.

On a high magnitude fault current, fusible element 26 usually melts or ruptures at a high instantaneous value of fault current. Plasma quickly fills nozzle 12, ablating its inner surfaces at a high rate. Plasma and gases from the arc ablated material of the clogged nozzle 12 flow in one direction into plasma conversion means 14 in the converter cap 16 and in the opposite direction into expansion chamber 42, increasing their pressures from the initial ambient value. Both flows expand as turbulent free jets mixing with the initial ambient gas.

The flow in the conversion means 14 is toroidal with turbulent mixing in the inner region and return flow between surfaces of plasma conversion means 14 in the outer region. As material 14 ablates, rupture of covalent polymer bonds absorb ionization energy, released as radiation when plasma ions combine forming free atoms and diatomic molecules. This process increases converter pressure and as current-zero approaches, lowers converter gas temperature. The high pressure end of the arc terminates at carbon electrode 18. Only plasma convected from clogged nozzle 12 enters the converter.

As the fault current decreases towards zero, the arc conducting the fault current begins to contract in diameter, reaching the arc eroded diameter of the high pressure electrode a fraction of a millisecond (ms) before current-zero. Unidirectional flow begins from stagnation pressure in converter cap 16 as the minimum flow area of the ring electrode 18 unclogs just prior to current-zero. Sonic velocities are reached at the minimum flow area, which is at or near the high pressure arc terminating electrode 18, becoming supersonic in the diverging flow of expansion chamber 42. During the fraction of a millisecond of unidirectional flow prior to current-zero, the cool arc quenching gases surround the arc, clear the expansion chamber of hot gases and reduce the diameter of the residual arc prior to current-zero.

Little or no subsonic plasma exists at current-zero and arc interruption is governed by supersonic turbulent cooling of the residual supersonic arc plasma. This cooling rate is highest an inch or two downstream from the sonic flow section, but continues throughout the length of supersonic turbulent flow.

Returning to the time of arc initiation, the second plasma stream from the bidirectional flow in clogged nozzle 12 enters the expansion chamber 42, which initially is bounded by surface 31 of fuse body 21 and piston 22, where it mixes with ambient gas and increases expansion chamber pressure. Piston 22, attached flexible conductor 28 and low pressure arc terminating electrode 32 accelerate towards the ambient opening 46. As it does, surface 38 becomes part of expansion chamber 42. After the arc eroded diameter of nozzle 12 becomes greater than the arc eroded diameter of electrode 18, some flow expansion will occur in nozzle 12 making it also a part of expansion chamber 42. Since the piston has the largest diameter of the supersonic expansion chamber, acceleration is maximized, achieving the longest arc length and supersonic turbulent mixing length possible by the first current-zero following arc initiation.

Alternating current faults last ½ cycle or more depending on asymmetry. Allowing for the fuse element to melt, the duration of arcing in interrupting devices are less. A range of 6 to 12 milliseconds arc duration should include most high magnitude faults in 60 Hz systems. During this time, the present invention: clears the expansion chamber of metal conductors; charges the converter with relatively cool, high hydrogen content gas at pressures approaching 100 atmospheres; erodes or otherwise consumes part of the clogging nozzle, high pressure arc terminating electrode, and expansion chamber, leaving the high pressure electrode 18 at or near the minimum sonic flow area of a controlled converging-diverging flow. These features help to provide an interrupter, free of slower cooling subsonic plasma, and capable of producing high Mach number supersonic flows over long lengths, with high hydrogen content gases for improved fault interrupting performance.

Figure 7:
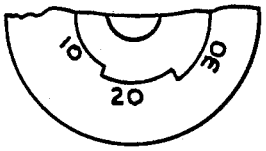
FIG. 7 is a elevational view, taken along sight line 7—7 of FIG. 1, showing means for estimating fault current magnitude during or after fuse replacement.

Here may be mentioned the function of the number scale on nozzle 12 as shown in FIG. 7. Since replacement fuse cartridge 20 interrupts only one fault and nozzle 12 experiences considerable arc erosion on high fault currents and does so in typically ½ cycle, the eroded diameter of nozzle 12 may be used as a measure fault current magnitude interrupted. The numbers are rms kA. Service personnel replacing a fuse of this invention after a fault can estimate fault location from indicated fault magnitude. Also, such fault magnitude data may be collected and used in system fault studies.

Before giving the reasons for the superior current-zero interruption performance of this invention, it is instructive to consider the reasons for the limitation on fault interruption performance of conventional expulsion fuses. At current-zero, conventional expulsion fuses have a long length of large diameter subsonic plasma in a fuse tube up to 10 inches long and 1 inch in diameter and a short length of supersonic turbulent plasma as an uncontrolled free jet in the ambient air. The subsonic plasma cools more slowly than the supersonic plasma and limits the fault interruption performance to typically 20 kA or less of rms asymmetrical fault current and 5 kHz or less transient recovery voltage frequency. Ragaller and Reichert give the time constant for cooling a similar subsonic plasma, between dual Laval nozzles of a gas circuit breaker, as the subsonic plasma length (stagnation pressure location to sonic throat) divided by the sonic plasma velocity (see Klaus Ragaller, Editor, *Current Interruption in High Voltage Networks*, Plenum Press, New York, 1978). In conventional expulsion fuses this length approaches the fuse tube length (about 10 inches) and is the primary reason for their limited fault interrupting performance.

A supersonic expulsion fuse of this invention has superior fault interrupting performance over a conventional expulsion fuse for two primary reasons. It eliminates the slower cooling subsonic plasma as a limitation on fault interruption performance. It also maximizes fault interruption performance by maximizing supersonic turbulent arc cooling rates. Each of these will be discussed in detail.

Subsonic plasma length is reduced to nearly zero by locating a ring-shaped arc terminating electrode, as 24 in FIG. 4 or 18 in FIG. 3 and FIG. 1, adjacent the high pressure end of clogging nozzle 12. On high fault currents, arc erosion leaves the electrode with the minimum flow area, hence located at the sonic flow section, with little or no subsonic plasma upstream. Plasma conversion means 14 assures that plasma entering it during the several milliseconds of arcing are converted to arc quench gases with temperatures below the ionization temperature before current-zero is reached. At current-zero, the residual plasma is a small diameter arc, terminating at or very near the minimum area sonic flow section, with nearly all of its length in the supersonic flow of the expansion chamber 42. The cooling time constant for subsonic plasma, which is proportional to subsonic plasma length from the stagnation pressure location to the sonic flow section, is essentially zero, effectively eliminating the slower cooling subsonic plasma as a limitation on fault interruption performance of the supersonic expulsion fuse.

The fault interruption performance of a supersonic expulsion fuse of this invention is limited by the cooling rates in the turbulent supersonic flow of expansion chamber 42. Both cooling rates and performance are maximized for four major reasons.

Surprisingly, the supersonic cooling rate in the supersonic flow downstream from the minimum flow section also depends on the length of subsonic plasma upstream from the sonic flow section. The cooling time constant for turbulent supersonic axial flow is given by Jones (see Klaus Ragaller, Editor, *Current Interruption in High Voltage Networks*, Plenum Press, New York, 1978) as proportional to arc radius squared, and thus the time constant depends on the time dependent radius of sonic plasma entering the supersonic divergent flow from the length of subsonic plasma upstream. This radius has a contraction time constant of twice the subsonic cooling time constant, making the supersonic time constant also equal to the subsonic plasma length divided by the sonic plasma velocity. At current-zero, the residual arc has a small diameter (about 1 mm in gas circuit breakers) which the supersonic turbulent flow must stretch, fragment, mix with relatively cool arc quench gas and cool by radiation and diffusion. In this way, the supersonic turbulent cooling rate also depends on the length of subsonic plasma upstream from the minimum flow area at current-zero. Since this invention reduces the current-zero subsonic plasma to nearly zero, supersonic turbulent cooling rates are maximized.

This invention creates a long length of supersonic turbulent flow in several ways: high sonic velocities of low atomic and molecular weight hydrogen rich gases; rapid expansion to maximum Mach numbers permitted by converter pressure; minimum arc eroded flow area and gas composition; parallel flow to ambient to retain high Mach velocities over a long distance; a piston-cylinder means to clear the supersonic interrupting length of the low pressure arc terminating electrode 32 before the first current-zero following arc initiation; clogged bidirectional flow throughout most of the arcing period to generate the pressure for clearing the long interrupting length and for producing the high pressure arc quench gases needed for supersonic turbulent arc cooling after current-zero.

Noeske has determined the relative thermal recovery speed of different gases and mixtures in nozzle arc interruption under identical test conditions (see H. O. Noeske, Arc *Thermal Recovery Speed in Different Gases,* IEEE, PAS-100, No. 11, November 1981, pp. 4612–4620.). He ranked $H_2$ and $CH_4$ as best, nearly two orders of magnitude faster than $SF_6$ or $CF_4$ gases. Therefore, polymers having high atomic percentages of hydrogen are preferred in this invention. Silicone polymer with methyl radicals (60% hydrogen) and polypropylene (67% hydrogen) are specific examples of materials preferred for the clogging nozzle 12, plasma conversion means 14, and fuse body 21, all of which may experience some ablation and contribute to the arc quench gas mixture at current-zero.

The plasma conversion means is functionally significant for producing the relatively cool arc quench gas available at current-zero. Both its material and its geometry are significant. The cylindrical geometry, coaxial with the clogging nozzle, and finned on its inside surface provides sufficient surface area of high hydrogen content material to absorb the plasma internal energy, most of which is ionization energy, and yet does not interfere with the turbulent mixing flow necessary to reduce arc quench gas temperatures below the ionization temperature before current-zero. A toroidal flow is established in the converter which ablates plasma conversion material 14 in the outer regions and mixes it turbulently with incoming plasma along the converter axis. This process of converting incoming plasma into arc quench gases continues throughout the high current period of clogged flow in nozzle 12. As nozzle 12 unclogs a fraction of a millisecond before current-zero, the high pressure quench gases produced in converter means 14 and stored in converter cap 16 are released to establish unidirectional supersonic turbulent flow in expansion chamber 42 throughout the interrupting period from current-zero through transient recovery voltage peak.

According to one aspect of the present invention, a supersonic fuse is provided with gas flow valving means which are particularly advantageous in conserving a limited source of pressurized gas. Several prior art circuit breakers utilizing pressurized gas have an internal containment vessel for storage of an arc quenching gas therein, usually at pressure levels significantly greater than the internal environment of the circuit breaker. The vessel is discharged from the initial moments of a fault current event throughout the fault clearing, and often, for some time therebeyond.

As has been seen above, the present invention can be used with much smaller sources of arc quenching gas, such as an ablative material which is stored as a solid until ready for use. The use of such solid material presents significant space savings and in general, is cheaper to manufacture. According to one feature of the present invention, relatively small quantities of solid materials can provide sufficient arc quenching performance, since they are conserved until a critical moment, when the converted material is released as an arc quenching gas.

In order to avoid premature release of the gas and to efficiently utilize the gas thus formed, the present invention provides a valving of the gas during a fault clearing event. As has been seen above, the nozzle 12 becomes clogged with plasma formed by vaporization of the nozzle wall and to a minor extent, by vapor from fusible element 26. This clogging action effectively valves off pressurized gas that is formed in converter cap 16 when the plasma conversion material 14 ablates or is otherwise transformed to cool plasma from nozzle 12. The pressurized gas thus produced is utilized to attain the numerous advantages described above.

As also described above, the nozzle 12 unclogs later in the arcing period. This unclogging begins at a precise moment in the fault clearing event, and operates as a switch or an open valve to turn on the flow of pressurized gas just in time to achieve fault clearing in the manner described above. As will now be appreciated by those skilled in the art, the timing for clogging and unclogging of nozzle 12 can be readily controlled using conventional techniques so as to release the pressurized gas at precisely the most optimum moment so as to achieve the desired fault clearing with a minimum amount of pressurized gas. Further, those skilled in the art will readily appreciate that the valving feature of the present invention can be readily scaled for fuse constructions of differing sizes, and of differing continuous current ratings and fault current ratings.

Figure 8:
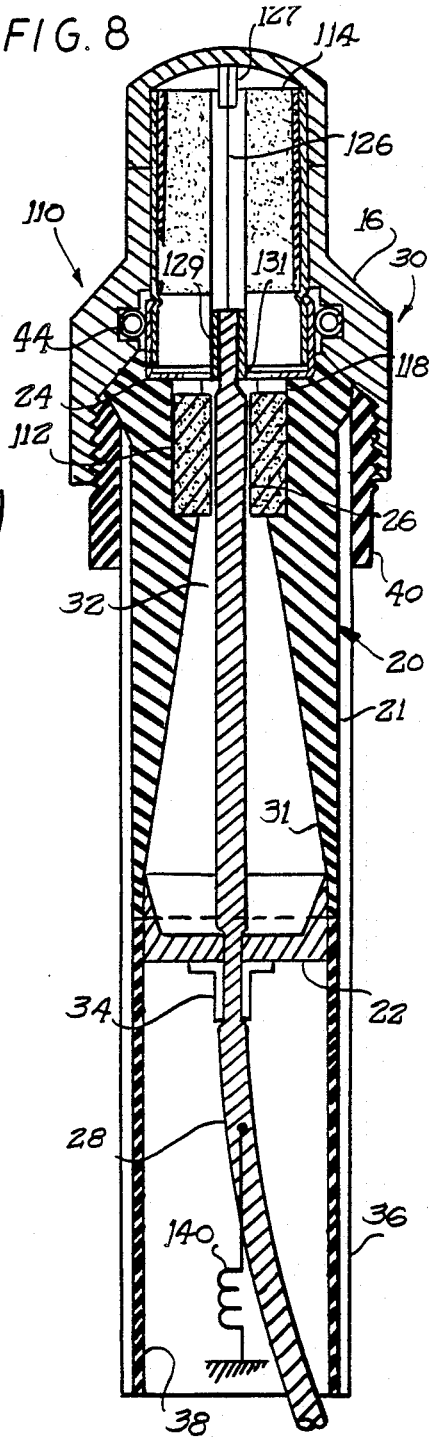
FIG. 8 is a cross-sectional view, with the section plane including the longitudinal axis, of an alternative embodiment of a supersonic expulsion fuse of the present invention.

Referring now to FIG. 8, an alternative embodiment of a fuse illustrating aspects of the present invention is generally indicated at 110. As will be seen herein, fuse 110 is identical in many of its aspects, to the fuse 10 described above with reference to FIG. 1. The principal difference between the fuses 10, 110 is in the placement of the fusible element. As was seen above, the fusible element 26 of FIG. 1 was located within the inner bore of nozzle 12, having a first end secured adjacent an upstream end of the nozzle and a second end, adjacent the downstream end of the nozzle connected at 32 to a flexible conductor 28.

In contrast, the fusible element 126 of FIG. 8 is attached at one end to a stationary third electrode or crimping ferrule 127 which is secured to the interior of converter cap 16. The second end of fusible element 126 is secured by a low pressure electrode or compression connector 129 to the free end of flexible conductor 28. The connector 129 preferably comprises a crimping barrel but other types of mechanical connections which also provide electrical connection between the fusible element and the flexible conductor can also be employed.

The high pressure electrode 118 preferably has a dielectric coating or is otherwise insulated from conductor 28 so as to remain nonconducting while the fusible element 126 conducts load currents, but which, when the fusible element ruptures, offers a lesser resistance path than the arc current path between the stationary electrode 127 and the low pressure electrode 129, so that the network current path during fault conditions is coupled by connecting means from the low pressure electrode 129 to the high pressure electrode 118, which in turn is coupled to the external network circuit through the converter cap 16. It is generally preferred that the lower end 131 of connector 129 be positioned immediately adjacent to or spaced slightly above the high pressure electrode 118, so that an arc will be transmitted or commutated thereto when the fusible element 126 ruptures, permitting movement of electrode 129 past electrode 118, with the upper end of the arc drawn to electrode 129 passing from the more distant electrode 127 to the nearer electrode 118. The fault current is thus connected to a path within nozzle 112 by connecting means which cause the above-described commutation.

As mentioned above, the upper free end of fusible element 26 of fuse 10 is secured adjacent the arc terminating electrode 18 by any suitable means, but preferably by soldering securement. As has been mentioned above, the nozzle 12 plays an important role in valving or switching the gas flow generated in and adjacent to the converter cap 16. Accordingly, the size or internal diameter of the nozzle is an important parameter which must be carefully controlled. Sustained, relatively small overloads not sufficiently large so as to cause a rupture of the fusible element 26 can, on occasion, produce a sufficient amount of heat so as to partially consume the internal bore of nozzle 12, thus affecting its switching or valving characteristics. The use of a solder securement to the upstream free end of fusible element 26 provides a controlled release for breaking the electrical current through fusible element 26 for those values of overcurrent which are not sufficiently great so as to rupture the fusible element.

The alternative embodiment 110 illustrated in FIG. 8 has an advantage in allowing the upper, upstream free end of the fusible element 126 to be secured to the fuse structure (preferably the inside of converter cap 16) by virtually any suitable means. For example, as illustrated, the free end of fusible element 126 can be secured with a crimping ferrule 127 and need not be secured with solder or other eutectic alloy because the relatively high melting point fusible element 126 is not located within or immediately adjacent the nozzle 112 and thus the nozzle is prevented from premature consumption due to a heat rise in the conductor positioned in its inner bore, prior to a fault clearing event.

When fuse 110 is made to carry an overcurrent, the fusible element 126 ruptures, initiating an electrical arc within the converter cap 16. The arcing of the ruptured fusible element causes the plasma conversion means 114 surrounding the fusible element to be ablated or otherwise transformed into a pressurized, arc-quenching gas which converts the conductive plasma into a dielectric gas. The arc will quickly burn along the length of the fusible element, and will travel to the crimping barrel 129, flashing over at its lower end 131 to the high pressure electrode 118. During this time, pressure caused by transformation of the material 114 causes the piston 22 to move in a downward direction, thereby displacing the low pressure electrode or crimping barrel 129, causing the crimping barrel to travel past the high pressure electrode 118 and the nozzle 112. The remainder of the operation of fuse 110 is similar to that described above for fuse 10.

If desired, a bias means such as a spring indicated schematically at 140 can be employed to tension the crimping barrel 129 in a generally downstream direction to quickly pull the crimping barrel past electrode 118. If desired, strain release wires or the like can be placed in parallel with the fusible element 126, in a manner which is known in the art, to prevent the bias means from altering the current interrupting properties of the fusible element 126.

A description of the present forms of the invention having been described by way of example, it is anticipated that variations of the described forms of the apparatus may be made without departing from the invention and the scope of the appended claims.

What is claimed:

1. A supersonic expulsion fuse in an ambient dielectric gas for conducting load currents and interrupting fault currents in a high voltage, alternating current network, comprising:

a. a pair of spaced arc terminating electrodes conductively connected in a current path of said network;

b. a fusible element conductively bridging said electrodes;

c. a short length, small cross-sectional area nozzle surrounding a portion of the length of said fusible element, said nozzle having an initial geometry and arc ablation characteristics to remain nearly filled with plasma during most of the arcing period preceding the period of interruption of the highest fault currents said fuse must interrupt;

d. a pressure chamber effectively sealed over one end of said nozzle, thereby enclosing one of said electrodes, designated the high pressure electrode; and e. an expansion chamber, effectively sealed over the opposing end of said nozzle and opening to said ambient gas through a flow area greater than said cross-sectional area of said nozzle, and the other electrode of said pair, designated the low pressure electrode, being initially located either inside said expansion chamber or outside it in said ambient gas.

2. The fuse as set forth in claim 1 wherein a minimum flow area is defined in at least one of said high pressure electrode and said nozzle, and wherein, during the period of fault current interruption in said fuse, i.e., between current-zero and a subsequent transient recovery voltage peak, the distance from said high pressure electrode to the minimum flow area is less than 2.0 inches.

3. The fuse as set forth in claim 1 wherein a minimum flow area is defined in at least one of said high pressure electrode and said nozzle, and wherein, said high pressure electrode is located adjacent said minimum flow area during a fault current interruption period.

4. The fuse as set forth in claim 3 wherein:

said high pressure electrode includes a ring structure having a central opening which erodes during said arcing period to define said minimum flow area during said fault current interruption period.

5. The fuse as set forth in claim 4 wherein:
said high pressure electrode ring is composed primarily of carbon in amorphous and/or graphite form.

6. The fuse as set forth in claim 1 wherein:
the material of said nozzle has a high atomic percentage of hydrogen.

7. The fuse as set forth in claim 6 wherein:
said nozzle material is a silicone polymer with methyl radicals.

8. The fuse as set forth in claim 6 wherein:
said nozzle material is a polyolefin polymer such as polypropylene.

9. The fuse as set forth in claim 1 wherein:
said pressure chamber further contains a plasma conversion means to absorb plasma internal energy and cool said plasma to temperatures below its ionization temperature during said arcing period preceding said fault arc interruption period.

10. The fuse as set forth in claim 9 wherein:
said plasma conversion means is a polymeric material with a high atomic hydrogen content.

11. The fuse as set forth in claim 1 wherein:
said expansion chamber is made from a polymeric material with a high atomic hydrogen content.

12. The fuse as set forth in claim 2 wherein:
during said fault current interruption period, the distance from said low pressure electrode to said minimum flow area is greater than 2.0 inches.

13. The fuse as set forth in claim 2 wherein:
said low pressure electrode is moveable and conductively attached to said fusible element near said nozzle, said low pressure electrode being conductively connected to said network by a means which permits motion of said electrode.

14. The fuse as set forth in claim 13 wherein:
said electrode or its said network connection means further includes a pressure surface means which accelerates said electrode towards said ambient opening in response to pressure from said nozzle during said arcing period preceding said fault arc interrupting period.

15. The fuse as set forth in claim 14 wherein:
during said fault current interrupting period, the distance from said low pressure electrode to said minimum flow area is greater than 2.0 inches.

16. The fuse as set forth in claim 1 wherein:
said expansion chamber contains two sections: a divergent flow section, adjacent said nozzle, having increasing flow area towards said ambient; and a parallel flow section, adjacent said ambient, having constant flow area.

17. The fuse as set forth in claim 16 wherein:
said low pressure electrode is moveable and conductively attached to said fusible element near said nozzle, said electrode being conductively connected to said network by means which permits motion of said electrode.

18. The fuse as set forth in claim 17 wherein:
said electrode or its said network connection means further includes a pressure surface means which accelerates said electrode towards said ambient opening in response to pressure from said nozzle during said arcing period preceding said fault current interrupting period.

19. The fuse as set forth in claim 18 wherein:
said pressure surface means is a piston which seals against said parallel flow section.

20. The fuse as set forth in claim 19 wherein:
during said fault current interruption period, the distance from said low pressure electrode to said minimum flow area is greater than 2.0 inches.

21. An expulsion fuse for use in a gaseous ambient environment to interrupt current through an alternating current circuit, comprising:
a housing;
first and second spaced electrodes in said housing electrically connected to said network to conduct the circuit current therethrough;
a fusible element electrically coupling said electrodes and initiating the generation of an electrical arc when an overload current is passed therethrough;
nozzle means for generating a pressurized gas when exposed to an electrical arc, said nozzle means surrounding at least a portion of said fusible element and having first and second opposed ends and a central passageway through which said fusible element passes, said passageway having a preselected length and cross-section;
a pressure chamber sealing the first end of said nozzle means, and enclosing said first electrode;
an expansion chamber adjacent the second end of said nozzle opening to said ambient environment, defining a flow area greater than the cross-sectional area of said nozzle means and having a longer length than the length of said nozzle means;
piston means in said expansion chamber for sealing the second end of said nozzle; and
said second electrode disposed in said expansion chamber.

22. The fuse of claim 21 further comprising an electrical conductor extending from said piston to an end of said fusible element.

23. The fuse of claim 22 wherein said electrical conductor comprises a section of a flexible cable extending from said ambient environment and through said piston and having an end in said expansion chamber connected to an end of said fusible element.

24. The fuse of claim 21 wherein said housing encloses said nozzle and said expansion chamber and further includes a tubular portion extending from said expansion chamber for guiding said piston.

25. The fuse of claim 21 wherein said first electrode is located immediately adjacent said first end of said nozzle means.

26. The fuse of claim 21 wherein said piston is made of a non-rigid dielectric material and has a tapered inner bore opening toward said high pressure electrode so as to form a piston free end of reduced thickness for sealing engagement with said expansion chamber when pressed thereagainst.

27. The fuse of claim 24 wherein said expansion chamber and said tubular portion are joined end-to-end along a joint line and said piston includes sidewall means overlying said joint line when said fuse is in a normal position, prior to conducting an overcurrent.

28. The fuse of claim 21 wherein said pressure chamber comprises a conductive ferrule in contact with said first electrode, and said fuse further comprises a spring contact pressed against said conductive ferrule to couple said circuit current thereto through a plurality of contact points.

29. The fuse of claim 21 wherein said nozzle means includes a central passageway of preselected diameter defined by a sidewall which is partially consumed when said fusible element ruptures, and said nozzle means includes indicia at the second end thereof for indicating the amount of such consumption so as to provide a measurement proportional to the magnitude of the overload current passing through said fusible element.

30. The fuse of claim 21 wherein said piston includes a generically cylindrical sidewall of tapering cross-section and having a reduced thickness adjacent said expansion chamber.

31. The fuse of claim 21 wherein said nozzle means comprises a hollow tubular body of preselected internal diameter, and said first electrode comprises an annular disk of larger internal diameter.

32. The fuse of claim 31 wherein said nozzle body and said first electrode are made of materials which are at least partially consumed when said fusible element ruptures, and said nozzle body is made of a material which is consumed more quickly than the material of said first electrode.

33. The fuse of claim 21 further comprising arc conversion means located adjacent said first electrode, said arc conversion means transformable upon exposure to an arc into a gas which converts plasma of the arc into a dielectric gas.

34. An expulsion fuse for use in a gaseous ambient environment to interrupt current through an alternating current circuit, comprising:

a housing;

first and second spaced electrodes in said housing electrically connected to said network to conduct the circuit current therethrough;

a fusible element electrically coupling said electrodes and initiating the generation of an electrical arc when an overload current is passed therethrough;

arc conversion means of arc quenching material located adjacent said first electrode on a first side thereof;

nozzle means for generating a pressurized gas when exposed to an electrical arc, said nozzle means surrounding at least a portion of said fusible element and having first and second opposed ends and a central passageway through which said fusible element passes, said passageway having a preselected length and cross-section;

a pressure chamber sealing the first end of said nozzle means, and enclosing said first electrode;

an expansion chamber adjacent the second end of said nozzle opening to said ambient environment, defining a flow area greater than the cross-sectional area of said nozzle means and having a longer length than the length of said nozzle means;

piston means in said expansion chamber for sealing the second end of said nozzle;

said second electrode disposed in said expansion chamber; and a tubular guide adjacent said expansion chamber, remote from said nozzle means for guiding said piston during an expansion of said pressurized gas in said expansion chamber.

35. A supersonic expulsion fuse in an ambient dielectric gas for conducting load currents and interrupting fault currents in a high voltage, alternating current network, comprising:

a plurality of spaced electrodes including a high pressure electrode and a low pressure electrode;

a fusible element conductively bridging at least two of said electrodes for initiating an electrical arc in response to an overload current;

a short length, small cross-sectional area nozzle having an internal bore, and an initial geometry and arc ablation characteristics to remain nearly filled with plasma during most of the arcing period preceding the period of interruption of at least some of the fault currents said fuse must interrupt;

connecting means for conductively connecting the high pressure and low pressure electrodes in a current path of said network extending through said nozzle bore;

a pressure chamber effectively sealed over one end of said nozzle, enclosing said high pressure electrode; and an expansion chamber, effectively sealed over an opposing end of said nozzle and opening to said ambient gas through a flow area greater than said cross-sectional area of said nozzle, and the low pressure electrode, being initially located either inside said expansion chamber or outside it in said ambient gas.

36. The fuse of claim 35 wherein said connecting means includes a third electrode within said pressure chamber connected to one end of said fusible element, said low pressure electrode is connected to the other end of said fusible element adjacent said high pressure electrode so as to establish an arc current path initiated by said fusible element therewith, and said connecting means further including means for moving said low pressure electrode through said nozzle bore so as to draw the arc current path therethrough.

37. The fuse of claim 35 wherein said high pressure and said low pressure electrodes are disposed on opposing ends of said nozzle and are connected to opposing ends of said fusible element and said connecting means includes conductive housing means for electrically coupling said high pressure electrode to a first point in said network and flexible conductor means for coupling said low pressure electrode to a second point in said network.

38. The fuse of claim 35 wherein said means for moving said low pressure electrode comprises a piston connected to said low pressure electrode and disposed within said expansion chamber so as to be driven away from said high pressure electrode by expanding gas in said expansion chamber.

* * * * *